US011783771B2

(12) United States Patent
Park

(10) Patent No.: US 11,783,771 B2
(45) Date of Patent: Oct. 10, 2023

(54) DISPLAY APPARATUS AND METHOD FOR CONTROLLING SAME

(71) Applicant: LG ELECTRONICS INC., Seoul (KR)

(72) Inventor: Shin Ho Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/639,429

(22) PCT Filed: Oct. 30, 2019

(86) PCT No.: PCT/KR2019/014461
§ 371 (c)(1),
(2) Date: Mar. 1, 2022

(87) PCT Pub. No.: WO2021/085672
PCT Pub. Date: May 6, 2021

(65) Prior Publication Data

US 2022/0293054 A1 Sep. 15, 2022

(51) Int. Cl.
*G09G 3/3233* (2016.01)

(52) U.S. Cl.
CPC ... *G09G 3/3233* (2013.01); *G09G 2300/0809* (2013.01); *G09G 2320/0257* (2013.01); *G09G 2320/0295* (2013.01); *G09G 2320/043* (2013.01); *G09G 2320/0686* (2013.01)

(58) Field of Classification Search
CPC ..... G09G 3/3233; G09G 2300/0809; G09G 2320/0257; G09G 2320/0295; G09G 2320/043; G09G 2320/0686
See application file for complete search history.

(56) References Cited

U.S. PATENT DOCUMENTS 6,618,030 B2 * 9/2003 Kane ..... G09G 3/3233 345/82
7,262,753 B2 * 8/2007 Tanghe ..... G09G 3/3216 345/82
8,125,417 B2 * 2/2012 Furuichi ..... G09G 3/3283 345/82
8,325,112 B2 * 12/2012 Park ..... G09G 3/3291 345/98
8,384,829 B2 * 2/2013 Yamashita ..... G09G 3/3233 348/649
8,497,827 B2 * 7/2013 Lee ..... G09G 3/3233 345/82

(Continued)

FOREIGN PATENT DOCUMENTS

KR 10-2014-0070792 A 6/2014
KR 10-2017-0003215 A 1/2017

(Continued)

*Primary Examiner* — Michael J Jansen, II
(74) *Attorney, Agent, or Firm* — Birch, Stewart, Kolasch & Birch, LLP

(57) ABSTRACT

Disclosed are a display apparatus and a method for controlling same. The disclosed display apparatus and method for controlling same execute a first operation and a second operation to prevent afterimages from appearing on a display panel, the afterimages being significantly reduced by executing the second operation using the history of the first operation.

18 Claims, 9 Drawing Sheets

(56) References Cited

U.S. PATENT DOCUMENTS 8,912,990 B2 * 12/2014 Vieri ..... G09G 3/3648 345/87
9,396,684 B2 * 7/2016 Bi ..... G09G 3/3275
9,984,633 B2 * 5/2018 Park ..... G09G 3/344
10,475,417 B2 * 11/2019 Jiang ..... G09G 3/007
10,572,965 B2 * 2/2020 Kambhatla ..... G09G 3/3208
10,699,622 B2 * 6/2020 Thompson ..... G06F 3/067
11,217,164 B2 * 1/2022 Kim ..... G09G 3/3225
11,295,703 B2 * 4/2022 Li ..... G09G 5/10
11,545,110 B2 * 1/2023 Yang ..... G09G 5/10
11,688,363 B2 * 6/2023 Yang ..... G09G 5/10 345/55
2001/0024186 A1 * 9/2001 Kane ..... G09G 3/3291 345/82
2005/0030267 A1 * 2/2005 Tanghe ..... G09G 3/3216 345/82
2009/0058772 A1 * 3/2009 Lee ..... G09G 3/3233 345/82
2009/0115707 A1 * 5/2009 Park ..... G09G 3/3291 345/76
2009/0244044 A1 * 10/2009 Furuichi ..... G09G 3/3283 345/211
2009/0273550 A1 * 11/2009 Vieri ..... G09G 3/3648 345/87
2012/0154682 A1 * 6/2012 Yamashita ..... G09G 3/3233 348/E9.037
2013/0050294 A1 * 2/2013 Hubo ..... H04N 5/58 345/690
2014/0148071 A1 5/2014 Kim et al.
2015/0123955 A1 * 5/2015 Bi ..... G09G 3/3258 345/694
2016/0125813 A1 * 5/2016 Park ..... G09G 3/344 345/107
2017/0345378 A1 11/2017 Ryu et al.
2018/0182288 A1 6/2018 Kim et al.
2018/0190174 A1 * 7/2018 Kambhatla ..... G06T 1/20
2018/0286356 A1 * 10/2018 Jiang ..... G09G 3/007
2018/0350296 A1 * 12/2018 Thompson ..... G06F 3/0673
2020/0372860 A1 * 11/2020 Kim ..... H04N 5/57
2021/0020140 A1 * 1/2021 Li ..... G09G 5/10
2021/0304673 A1 * 9/2021 Gao ..... G09G 3/3233
2022/0076629 A1 * 3/2022 Yang ..... G09G 3/3696
2022/0093059 A1 * 3/2022 Yang ..... G09G 3/20
2022/0293054 A1 * 9/2022 Park ..... G09G 3/3233

FOREIGN PATENT DOCUMENTS

KR 10-2017-0053987 A 5/2017
KR 10-2017-0081094 A 7/2017
KR 10-2018-0077412 A 7/2018

* cited by examiner

[FIG. 1]
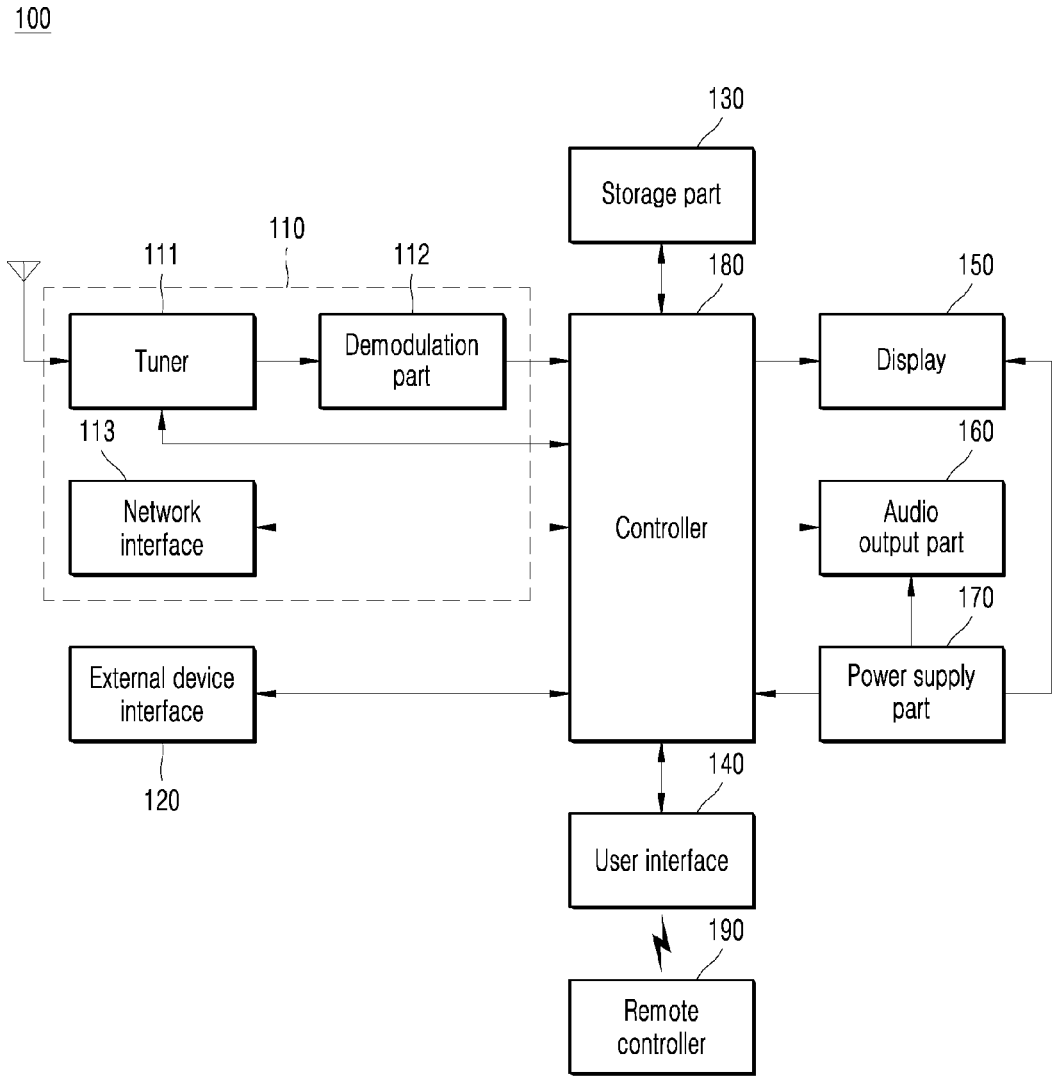

[FIG. 2]
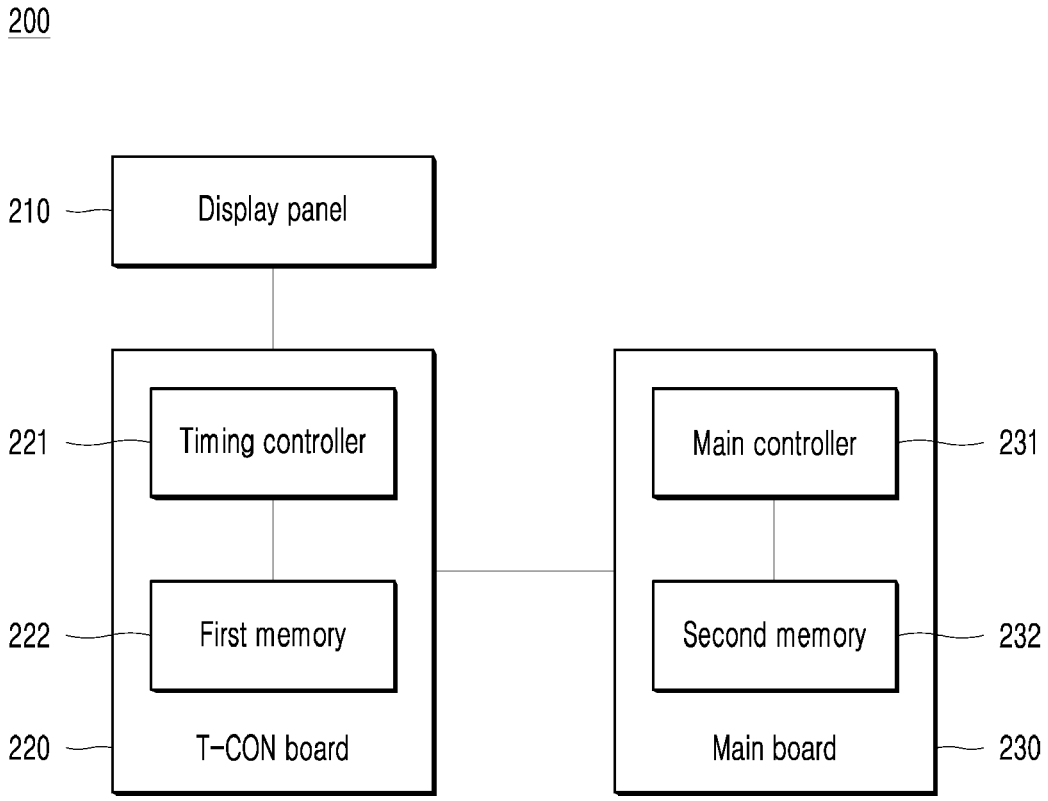

[FIG. 3]
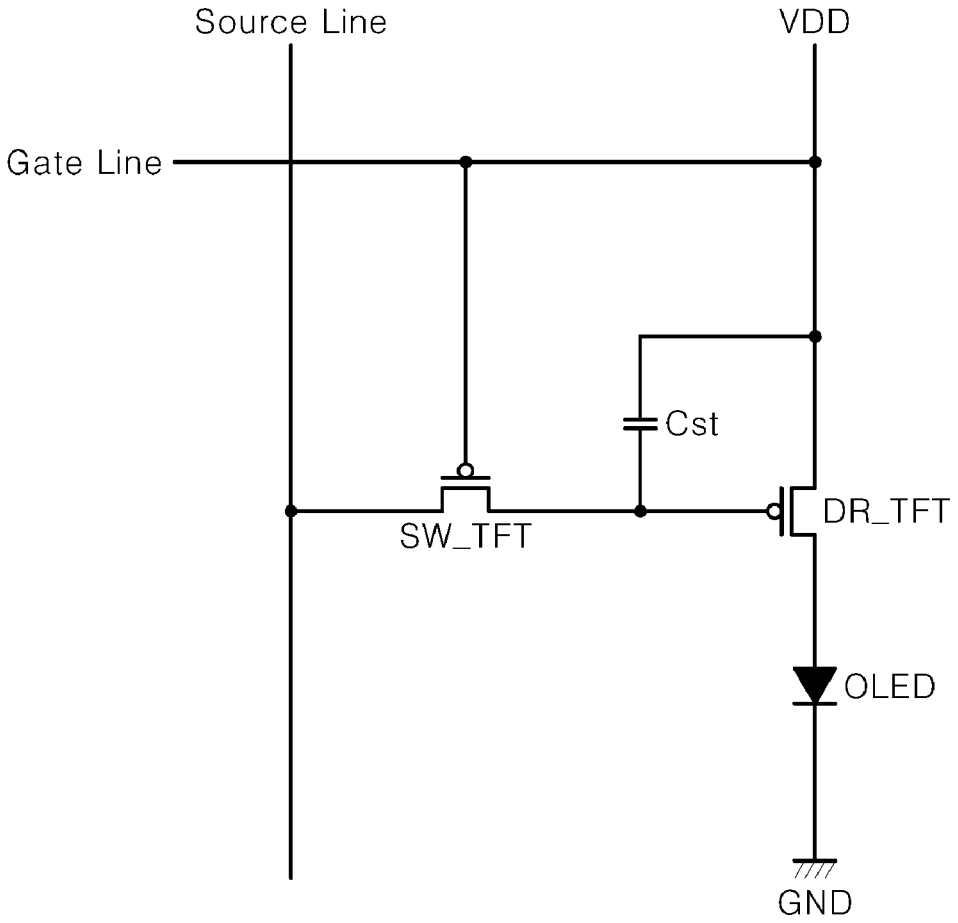

[FIG. 4]
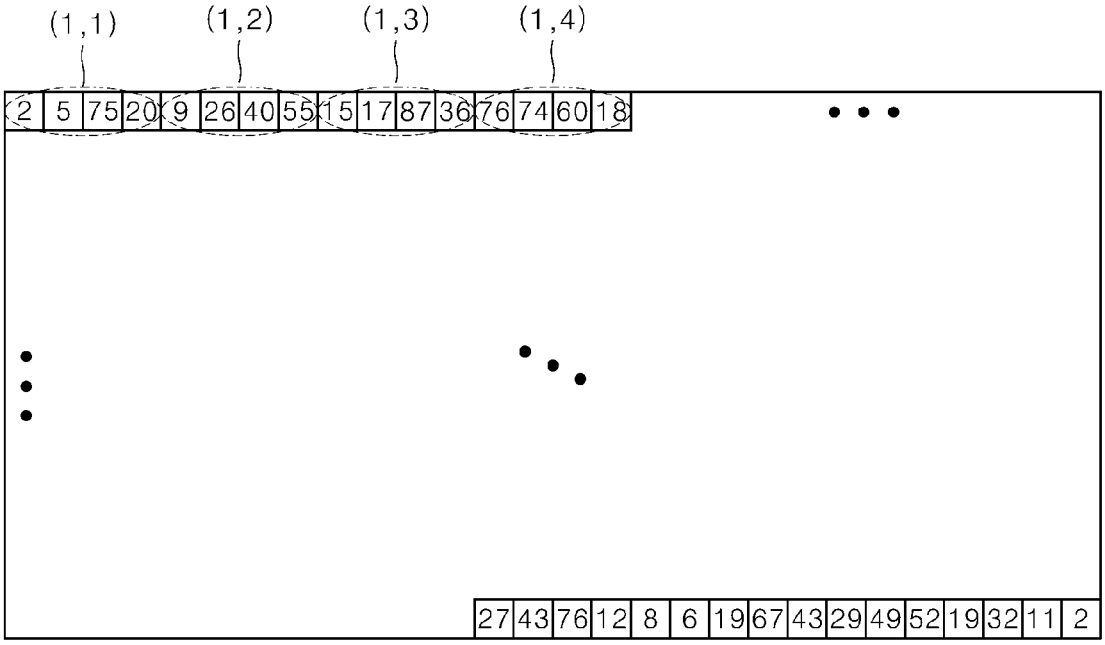

[FIG. 5]
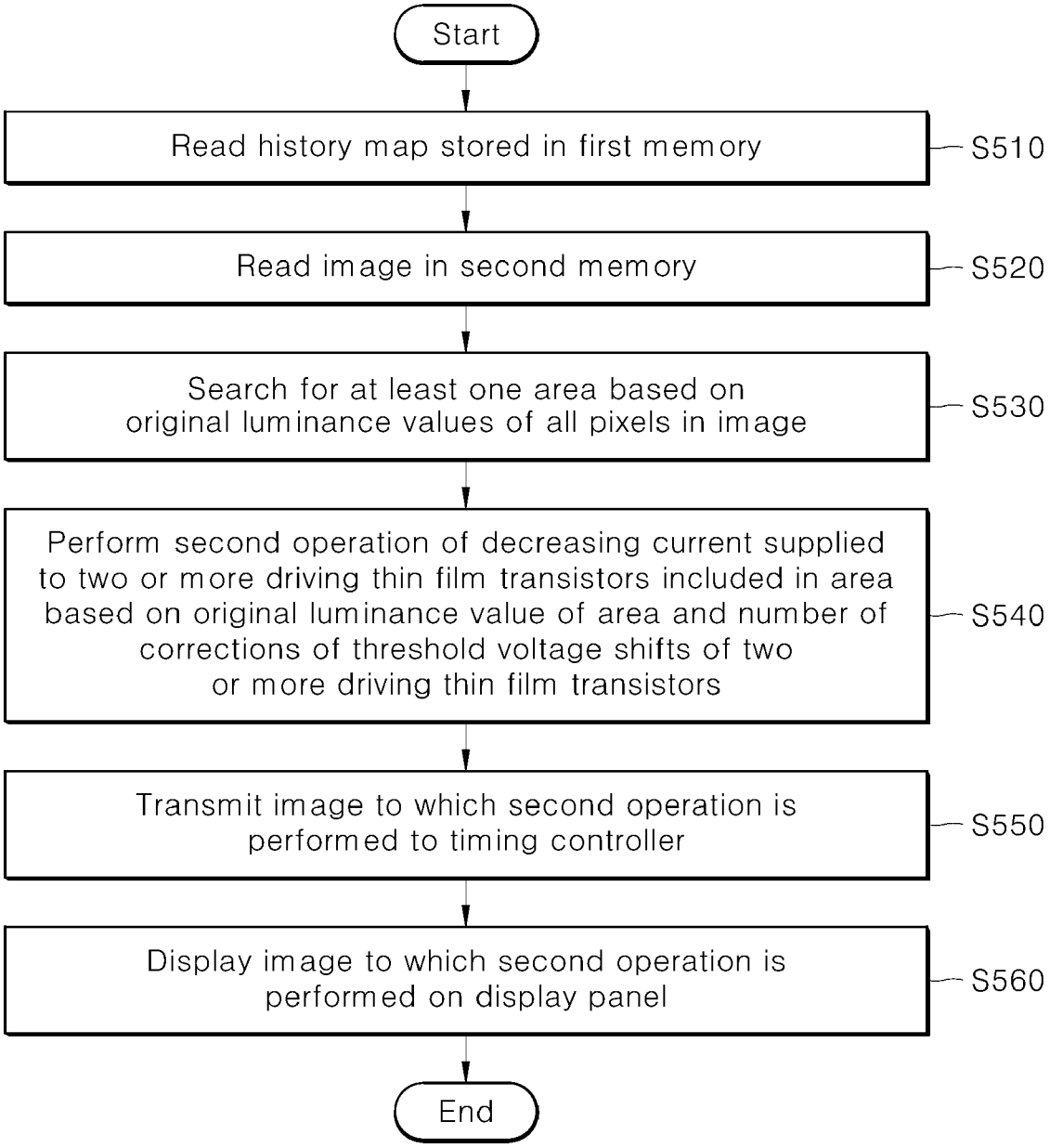

[FIG. 6]
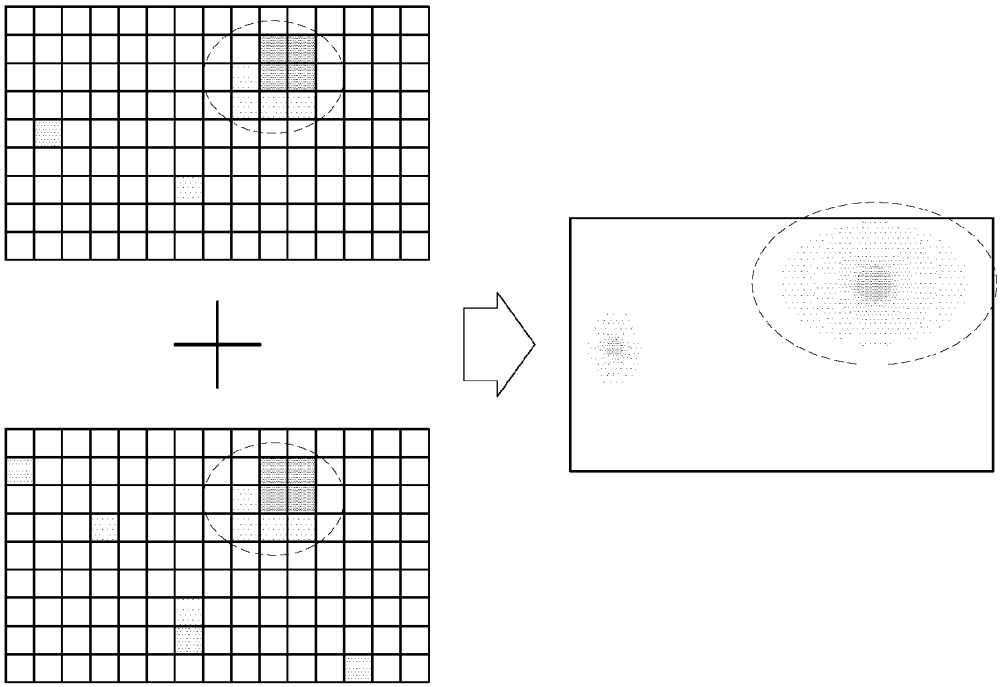

[FIG. 7]
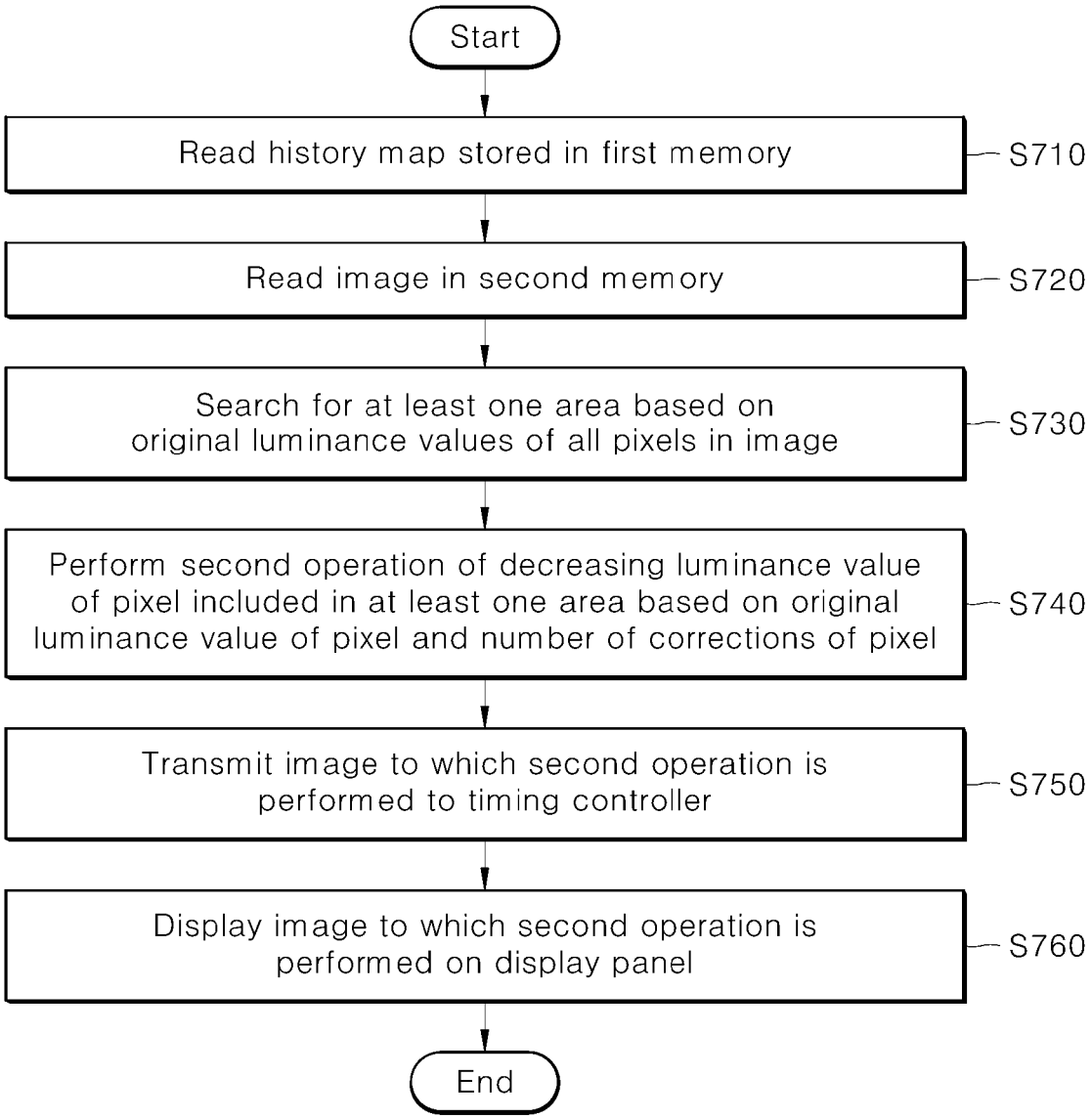

[FIG. 8]
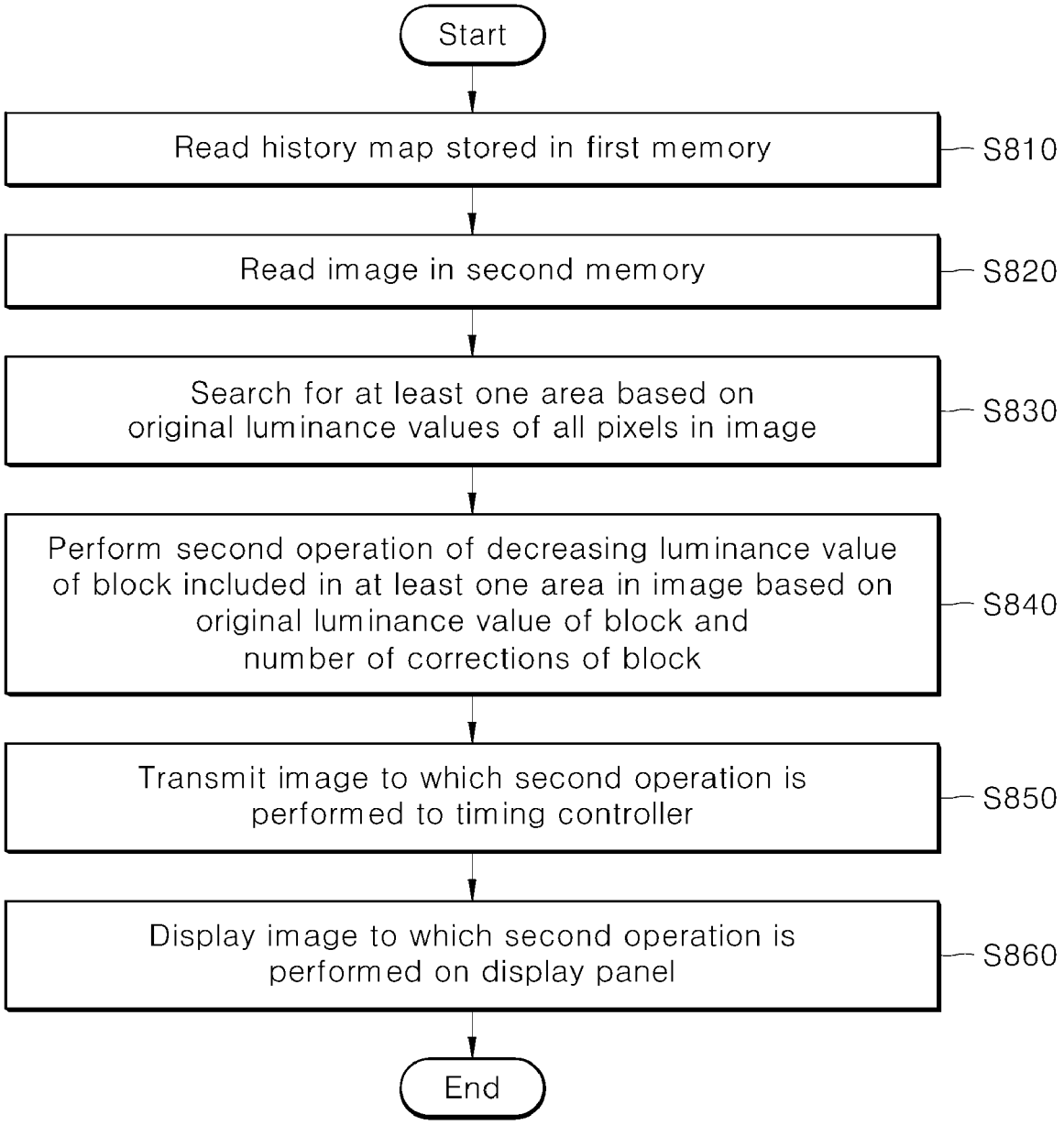

[FIG. 9]

| | | | | | |
|---|---|---|---|---|---|
| 80 | 80 | 80 | 80 | 80 | 80 |
| 80 | 80 | 80 | 80 | 80 | 80 |
| 80 | 80 | 80 | 80 | 80 | 80 |
| 80 | 80 | 80 | 78 | 78 | 78 |
| 80 | 80 | 80 | 78 | 68 | 68 |
| 80 | 80 | 80 | 78 | 68 | 60 |

DISPLAY APPARATUS AND METHOD FOR CONTROLLING SAME

Cross Reference to Related Applications

This application is the National Phase of PCT International Application No. PCT/KR2019/014461, filed on Oct. 30, 2019, all of which is hereby expressly incorporated by reference into the present application.

TECHNICAL FIELD

Disclosed herein are a display apparatus and a method for controlling the same that can reduce afterimages.

BACKGROUND ART

Display apparatuses provide images to allow users to see the images. A user can see broadcast materials through a display apparatus. The display apparatus provides a broadcast signal (i.e., a broadcast video) selected by the user, among broadcast signals emitted by a broadcast station, and the broadcast video is displayed on the display apparatus.

Display apparatuses are categorized into a liquid crystal display (LCD), a plasma display panel (PDP), an organic light-emitting diode (OLED) display, and the like.

In particular, in the OLED display apparatus, OLED elements in which pixels themselves emit light are used. Accordingly, unlike the LCD display apparatus and the like, the OLED display apparatus requires no back light, is embodied as a thin film, becomes lightweight, and ensures excellent contrast and color reproduction.

However, in the OLED display apparatus, afterimages appear on a display panel because of the way that the OLED display apparatus emits light and characteristics of OLED elements.

DESCRIPTION OF INVENTION

Technical Problems

One objective of the present disclosure is to provide a display apparatus and a method for controlling the same that reduces afterimages.

Another objective of the present disclosure is to provide a display apparatus and a method for controlling the same that prevents degradation of OLED elements.

Aspects according to the present disclosure are not limited to the above ones, and other aspects and advantages that are not mentioned above can be clearly understood from the following description and can be more clearly understood from the embodiments set forth herein. Additionally, the aspects and advantages in the present disclosure can be realized via means and combinations thereof that are described in the appended claims.

Technical Solutions

In a display apparatus and a method for controlling the same of one embodiment, while a first operation and a second operation for preventing afterimages appearing on a display panel are performed, the second operation is performed, based on a history of the first operation, to significantly reduce afterimages.

The display apparatus of one embodiment includes a display panel, a timing controller driving the display panel, performing a first operation for preventing afterimages appearing on the display panel and generating a history map of the first operation, and a main controller providing an image to the display panel and performing a second operation for preventing the afterimages, based on the history map and a original luminance of an image to be displayed on the display panel, wherein the image to which the second operation is performed is displayed on the display panel.

A display apparatus of another embodiment includes a display panel, a timing controller performing a first operation of correcting a threshold voltage shift of a plurality of driving transistors included in the display panel and generating a history map of the first operation, a memory storing the history map, and a main controller performing a second operation of adjusting the stored history map and a luminance value of an image to be displayed on the display panel and transmitting the image to which the second operation is performed to the display panel.

A method for controlling a display apparatus of yet another embodiment includes performing a first operation for preventing afterimages appearing on a display panel multiple times and generating a history map by a timing controller, performing a second operation for preventing the afterimages based on the history map and a original luminance value of an image to be displayed on the display panel by a main controller, and displaying the image to which the second operation is performed on the display panel.

Advantageous Effects

According to the present disclosure, afterimages appearing on a display apparatus may decrease.

According to the present disclosure, degradation of OLED elements in a display apparatus may be prevented.

According to the present disclosure, the lifespan of a display panel in a display apparatus may increase.

Specific effects are described along with the above-described effects in the section of Detailed Description.

BRIEF DESCRIPTION OF DRAWINGS

FIG. 1 is a view showing a schematic configuration of a digital device of one embodiment.

FIG. 2 is a view showing a schematic configuration of the display apparatus of one embodiment.

FIG. 3 is a view showing a circuit structure of each of two or more cells included in a pixel.

FIG. 4 is a view for describing the concept of a history map of one embodiment.

FIG. 5 is a flow chart showing a method for controlling a display apparatus of a first embodiment.

FIG. 6 is a view for describing the concept of a second operation of a main controller of one embodiment.

FIG. 7 is a flow chart showing a method for controlling a display apparatus of a second embodiment.

FIG. 8 is a flow chart showing a method for controlling a display apparatus of a third embodiment.

FIG. 9 is a view for describing the concept of an operation for preventing a flicker according to the present disclosure.

DETAILED DESCRIPTION OF EXEMPLARY EMBODIMENTS

The above-described aspects, features and advantages are specifically described hereunder with reference to the accompanying drawings such that one having ordinary skill in the art to which the present disclosure pertains can easily implement the technical spirit of the disclosure. In the disclosure, detailed description of known technologies in relation to the disclosure is omitted if it is deemed to make the gist of the disclosure unnecessarily vague. Below, preferred embodiments according to the disclosure are specifically described with reference to the accompanying drawings. In the drawings, identical reference numerals can denote identical or similar components.

The terms "first", "second" and the like are used herein only to distinguish one component from another component. Thus, the components should not be limited by the terms. Certainly, a first component can be a second component unless stated to the contrary.

When any one component is described as being in the "upper portion (or lower portion)" of another component or "on (or under)" another component, any one component can be disposed on the upper surface (or lower surface) of another component, and an additional component can be interposed between the two components.

When any one component is described as being "connected", "coupled" or "connected" to another component, any one component can be directly connected or connected to another component, but an additional component can be "interposed" between the two components or the two components can be "connected", "coupled" or "connected" by an additional component.

Throughput the disclosure, each component can be provided as a single one or a plurality of ones, unless explicitly indicated otherwise.

In the disclosure, the singular forms "a", "an" and "the" are intended to include the plural forms as well, unless explicitly indicated otherwise. It is to be understood that the term "comprise" or "include," when used in this disclosure, is not interpreted as necessarily including stated components or steps, but can be interpreted as excluding some of the stated components or steps or as further including additional components or steps.

Throughout the disclosure, the terms "A and/or B" as used herein can denote A, B or A and B, and the terms "C to D" can denote C or greater and D or less, unless stated to the contrary.

As an intelligent display apparatus in which a computer assist function is added to a broadcast reception function, for example, the display apparatus in the present disclosure can perform an Internet function and the like as well as a broadcast reception function, and be equipped with an interface that can be used more readily than a handwriting-based input device, a touch screen or a space remote controller and the like. Assisted with a wired or wireless Internet function, the display apparatus can access the Internet and a computer, and perform the functions of e-mailing, web browsing, banking, or gaming and the like. Standardized and widely-used OAs can be used for the above functions.

In the display apparatus according to the disclosure, various types of applications can be freely added onto or removed from a widely used OS kernel, for example, thereby enabling the display apparatus to perform of various user-friendly functions. Specifically, the display apparatus can include a network display apparatus, an HBB display apparatus, a smart display apparatus, an LED display apparatus, an OLED display apparatus and the like, and in some cases, can be applied to a mobile terminal.

The mobile terminal in the present disclosure may include mobile phones, smart phones, laptop computers, digital broadcast terminals, personal digital assistants, portable multimedia players, navigators, slate PCs, tablet PCs, ultrabooks, wearable devices (e.g., a watch-type terminal (a smartwatch), glass-type terminals (smart glasses), head mounted displays (HMD) and the like.

However, one having ordinary skill in the art can understand that the configurations of the embodiments in the disclosure can be applied to fixed terminals such as a digital display apparatus, a desktop computer, a digital signage and the like, except that the configurations are applicable only to mobile terminals.

Hereafter, a display apparatus and a method for controlling the same of several embodiments are described.

FIG. 1 is a view showing a schematic configuration of a digital device of one embodiment.

Referring to FIG. 1, the digital device 100 may include a broadcast reception part 110, an external device interface 120, a storage part 130, a user interface 140, a display 150, an audio output part 160, a power supply part 170, and a controller 180.

The broadcast reception part 110 may include a tuner 111, a demodulation part 112, and a network interface 113. However, in some cases, the broadcast reception part 110 may include the tuner 111 and the demodulation part 112 and exclude the network interface 113, or vice versa.

The broadcast reception part 110 may include a multiplexer, though not illustrated. In this case, the multiplexer may multiplex a signal demodulated by the demodulation part 112, and a signal received through the network interface 113. Besides, the broadcast reception part 110 may also include a demultiplexer, though not illustrated. The demultiplexer demultiplexes multiplexed signals, or a signal demodulated by the demodulation part 112 or a signal received through the network interface 113.

The tuner 111 tunes a specific radio frequency (RF) broadcast signal. The specific RF broadcast signal corresponds to a channel selected by a user or all pre-stored channels. Additionally, the tuner 111 converts the RF broadcast signal into an intermediate frequency (IF) signal or a baseband signal.

For example, the tuner 111 converts an RF broadcast signal, a digital broadcast signal, into a digital IF (DIF) signal, and converts an RF broadcast signal, an analogue broadcast signal, into an analogue baseband image or a voice signal (CVBS/SIF). That is, the tuner 111 may process all the digital broadcast signal and the analogue broadcast signal. The analogue baseband image or the voice signal (CVBS/SIF) output from the tuner 111 may be directly input to the controller 180.

Further, the tuner 111 may receive an RF broadcast signal of a single carrier or a multiple carrier. The tuner 111 may consecutively tune and receive RF broadcast signals of all broadcast channels that are stored using a channel memory function, and convert the tuned and received RF broadcast signals into IF signals or baseband signals.

The demodulation part 112 may receive and demodulate the digital IF signals converted by the tuner 111, and may perform channel decoding, and the like. To this end, the demodulation part 112 may be provided with a Trellis decoder, a de-interleaver, a Reed-Solomon decoder and the like, or a convolution decoder, a de-interleaver, a Reed-Solomon decoder and the like.

The demodulation part 112 may output a stream signal TS after performing demodulation and channel decoding. In this case, the stream signal may be a signal where an image signal, a voice signal or a data signal is multiplexed. In an example, the stream signal may be an MPEG-2 transport stream (TS) where an image signal of the MPEG-2 standard, a voice signal of the Dolby AC-3 standard, and the like are multiplexed.

The stream signal output by the demodulation part 112 may be input to the controller 180. The controller 180 may control demultiplexing, image/voice signal processing and the like, and control output of an image through the display 150 and output of a voice through the audio output part 160.

The external device interface 120 provides an environment for interface between the digital device 100 and various types of external devices.

The external device interface 120 may connect to an external device and the like such as a digital versatile disk (DVD), Blu-ray, a game device, a camera, a camcorder, a computer (a lap top), a tablet PC, a smart phone, a Bluetooth device, Cloud and the like in a wired/wireless manner. The external device interface 120 delivers data signals including an image, a video, a voice, input through the external device, to the controller 180. The controller 180 may control a processed data signals, such as the image, the video, and the voice, to be output to the external device. To this end, the external device interface 120 may further include an A/V input/output part (not illustrated) or a wireless communicator (not illustrated).

The A/V input/output part may include a USB terminal, a Composite Video Banking Sync (CVBS) terminal, a component terminal, an S-video terminal (analogue), a Digital Visual Interface (DVI) terminal, a High Definition Multimedia Interface (HDMI) terminal, an RGB terminal, a D-SUB terminal and the like, to input an image signal and a voice signal of the external device to the digital device 100.

The wireless communicator may perform near field communication with another digital device. The digital device 100, for example, may connect to another digital device, based on a communication protocol such as Bluetooth, Radio Frequency Identification (RFID), Infrared Data Association (IrDA), ultra wideband (UWB), ZigBee, Digital Living Network Alliance (DLNA) and the like.

Additionally, the external device interface 120 makes access through a set-top box (STB) and at least one of the above terminals, and may perform an input/output operation along with the set-top box.

Further, the external device interface 120 may receive an application or an application list in an adjacent external device, and deliver the application or the application list to the controller 180 or the storage part 130.

The network interface 113 provides an interface for connecting the digital device 100 to a wired/wireless network. The network interface 113 may be provided with an Ethernet terminal and the like, for a connection with a wired network, and may use communication standards and the like such as Wireless LAN (WLAN), Wi-Fi, wireless broadband (WiBro), World Interoperability for Microwave Access (Wimax), High Speed Downlink Packet Access (HSDPA) and the like, for a connection with a wireless network.

The network interface 113 may transmit data to another digital device, and receive data from another digital device, through its connected network or another network linked to its connected network. In particular, the network interface 113 may transmit a portion of content data stored in the digital device 100 to a selected digital device out of other pre-registered digital devices.

Additionally, the network interface 113 may access a predetermined web page through its connected network or another network linked to its connected network. That is, the network interface 113 may access the predetermined web page through a network, and transmit data to and receive data from a corresponding server. Besides, the network interface 113 may receive content or data provided by a content provider or a network operator. That is, the network interface 113 may receive contents such as a movie, an advertisement, a game, a VOD, a broadcast signal and the like, which are provided by the content provider or the network provider through a network, and information thereon. Further, the network interface 113 may receive firmware update information and update file provided by the network operator. Furthermore, the network interface 113 may transmit data to an internet, the content provider or the network operator.

The network interface 113 may select and receive a desired application among open applications through a network.

Programs for processing and controlling each signal in the controller 180 may be stored in the storage part 130, and the signal-processed image, voice, or data signal may be stored in the storage part 130.

An images, a voice or a data signal, input from the external device interface 120 or the network interface 113, may be temporarily stored in the storage part 130. Information on predetermined broadcast channels may be stored in the storage part 130, based on a channel memory function.

An application or an application list, input from the external device interface 120 or a network interface 330, may be stored in the storage part 130.

Various platforms described below may also be stored in the storage part 130.

The storage part 130 may include a storage medium of at least one of flash memory type, hard disk type, multimedia card micro type, card type memories (e.g., an SD or XD memory and the like), RAM, and ROM (EEPROM and the like). The digital device 100 may reproduce content files (a video file, an image file, a music file, a document file, an application file and the like) stored in the storage part 130 and provide the same to the user.

The storage part 130 may be included in the controller 130 or may separate from the controller 180.

The user input interface 140 delivers a signal input by the user to the controller 180 or deliver a signal of the controller 180 to the user.

For example, the user input interface 140 may connect to a remote control device 190, using a variety of communication methods such as an RF communication method, an infrared (IR) communication method and the like. The user input interface 140 may receive and process control signals for power on/off, channel selection, display setting and the like that are transmitted by the remote control device 190, or transmit a control signal of the controller 180 to the remote control device 500. Additionally, the user input interface 140 may deliver control signals input from a power key, a channel key, a volume key, and a local key (not illustrated) such as a setting key and the like, to the controller 180.

The user input interface 140 may deliver a control signal input by a sensing part (not illustrated) that senses a gesture of the user to the controller 180, or transmit a signal of the controller 180 to the sensing part (not illustrated). The sensing part (not illustrated) may include a touch sensor, a voice sensor, a position sensor, a motion sensor and the like.

The controller 180 may demultiplex a stream input through the tuner 111, the demodulation part 112, or the external device interface 120 or process demultiplexed signals, to generate and output a signal for outputting an image or a voice.

An image signal processed by the controller 180 may be input to the display 150, and displayed as an image corresponding to the image signal. Additionally, the image signal processed by the controller 180 may be input to an external output device through the external device interface 120.

A voice signal processed by the controller 180 may be output acoustically to the audio output part 160. Further, a voice signal processed by the controller 180 may be input to an external output device through the external device interface 120.

The controller 180 may include a demultiplexer, an image processing part and the like.

The controller 180 may control operations of the digital device 100 entirely. For example, the controller 180 may control the tuner 111 such that the tuner 111 tunes RF broadcast corresponding to a channel selected by the user or a pre-stored channel.

The controller 180 may control the digital device 100, using a user instruction input through the user input interface 140 or an internal program. In particular, the controller 180 may access a network and download an application desired by the user or an application list in the digital device 100.

For example, the controller 180 controls the tuner 111 such that a signal of the selected channel is input according to an instruction to select a predetermined channel, which is received through the user input interface 140. Then the controller 180 processes image, voice or data signal related to the selected channel. The controller 180 controls image signal or audio signal related to the channel information selected by the user to be output through the display 150 or the audio output part 160.

In another example, the controller 180 controls an image signal or an audio signal received from an external device to be output through the display unit 150 or the audio output unit 160 according to an external device image reproduction command based on the an instruction to reproduce an external device image, which is received through the user input interface 140.

Additionally, the controller 180 may control the display 150 such that the display 150 displays an image. For example, the controller 180 controls the display 150 such that the display 150 displays a broadcast image input through the tuner 111, an externally input image input through the external device interface 120, an image input through the network interface, or an image stored in the storage part 130. In this case, the image displayed on the display 150 may be a still image or a moving image, and a 2D image or a 3D image.

Further, the controller 180 may control the display 150 such that the display 150 reproduces content. In this case, the content may be content stored in the digital device 100, received broadcast content, or externally input content input from the outside. The content may be at least one of broadcast content, an externally input image, an audio file, a still image, an accessed web screen, and a document file.

When entering the application library, the controller 180 may control the display such that the display displays an application or an application list that can be downloaded from the internal or external network of the digital device 100.

The controller 180 may install and drive an application downloaded from an external network together with various types of user interfaces. Furthermore, the controller 180 may control the display 150 such that the display 150 displays an image in relation to an application that is executed as the user selects the application.

Though not illustrated, a channel browsing processing part that produces a thumbnail image corresponding to a channel signal or an externally input signal can be further provided.

The channel browsing processing part may receive a stream signal TS output by a demodulation part 320 or a stream signal output by the external device interface 120 and the like, extract an image from the input stream signal, and produce a thumbnail image. The produced thumbnail image may be input to the controller 180 as it is, or encoded and input to the controller 180. The produced thumbnail image may also be encoded as a stream and input to the controller 180. The controller 180 may display a thumbnail list that includes a plurality of thumbnail images, based on the input thumbnail image, on the display 150. The thumbnail images in the thumbnail list may be updated one by one or at the same time. Accordingly, the user may easily know about contents of a plurality of broadcast channels.

The display 150 converts an image signal, a data signal and an OSD signal that are processed by the controller 180, or an image signal, a data signal and the like that are received from the external device interface 120 respectively into RGB signals, and generates a driving signal.

The display 150 may be a PDP display, an LCD display, an OLED display, a flexible display, a 3D display, and the like.

The display 150 may be embodied as a touch screen and used as an input device in addition to an output device.

The audio output part 160 receives a signal processed by the controller 180 as a voice, e.g., a stereo signal, a 3.1 channel signal or a 5.1 channel signal, and outputs the signal as a voice. The voice output part 160 may be embodied various types of speakers.

The digital device 100, as described above, may be further provided with a sensing part (not illustrated) including at least one of a touch sensor, a voice sensor and a motion sensor, to sense a gesture of the user. A signal sensed by the sensing part (not illustrated) may be delivered to the controller 3180 through the user input interface 140.

A capturing part (not illustrated) that captures an image of a user may be further provided. Image information captured by the capturing part (not illustrated) may be input to the controller 180.

The controller 180 may use an image captured by the capturing part (not illustrated) or a signal sensed by the sensing part (not illustrated) respectively or in combination, to sense a gesture of the user.

The power supply part 170 supplies power to the components of the digital device 100. In particular, the power supply part 170 may supply power to the controller 180 capable of being embodied as a system on chip (SoC), the display 150 for an image display, and the audio output part 160 for an audio output.

To this end, the power supply part 170 may be provided with a converter (not illustrated) that converts AC power into DC power. When the display 150 is embodied as a liquid crystal panel provided with a plurality of backlight lamps, the power supply part 170 may be further provided with an inverter (not illustrated) capable of a pulse width modulation (PWM) operation, for luminance variations or dimming driving.

The digital device 100 may be a digital broadcast receiver that can process digital broadcast signals of a fixed or mobile ATSC method or a DVB method.

Besides, the digital device 100 may exclude some of the components that are illustrated, or further include components that are not illustrated, when necessary. The digital device 100 may receive content through the network interface or the external device interface and reproduce the content, without including the tuner and the demodulation part.

The above-stated details may be applied to below-described details of the present disclosure, and used to specify and clarify the technical features presented in the disclosure.

FIG. 2 is a view showing a schematic configuration of the display apparatus of one embodiment.

Referring to FIG. 2, the display apparatus 200 includes a display panel 210, a T-CON board 220 and a main board 230. The T-CON board 220 includes a timing controller 221 and a first memory 222, and the main board 230 includes a main controller 231 and a second memory 232. The display panel 210 and the T-CON board 220 may be included in a display unit.

Additionally, the display apparatus 200 may be a display apparatus using an OLED element, for example, an OLED TV. Hereafter, suppose that the display apparatus 200 is an OLDE TV, for convenience of description. However, the display apparatus according to the disclosure is not limited to an OLDE TV.

Hereafter, functions of each component are specifically described.

The display panel 210 displays an image.

The display panel 210 includes a plurality of pixels that are arranged two-dimensionally. Two or more cells are included in each of the plurality of pixels.

In one example, each of the plurality of pixels may include a first cell for emitting white light, a second cell for emitting red light, a third cell for emitting green light, and fourth cell for emitting blue light. In another example, each of the plurality of pixels may include may only include a first cell for emitting red light, a second cell for emitting green light, and a third cell for emitting blue light.

FIG. 3 is a view showing a circuit structure of each of two or more cells included in a pixel.

Referring to FIG. 3, a cell 300 includes a first thin film transistor SW_TFT, a second thin film transistor DR_TFT, a capacitor CST, an OLED element and the like. Herein, the second thin film transistor DR_TFT is a driving thin film transistor for driving the OLED element.

In summary, the display panel 210 includes a plurality of pixels, each of the plurality of pixels includes 3 to 4 cells, and each cell includes a single driving thin film transistor. Accordingly, the display panel 210 includes a plurality of driving thin film transistors that are arranged two-dimensionally.

When the display panel 210 using an OLED element is used for a long time, an afterimage appears on the display panel 210 due to features of the OLED element consisting of an organic material. Additionally, as threshold voltage VTH of the driving thin film transistor included in a cell is shifted because of problems in processing or usage, more afterimages appear due to the shifted threshold voltage. That is, the threshold voltage is shifted in the negative direction, more current is supplied to the driving thin film transistor and degrades the OLED element further.

According to the present disclosure, afterimages appearing on the display panel 210 may effectively decrease, based on the descriptions provided hereafter. Hereafter, a configuration that helps to reduce afterimages is specifically described.

The timing controller 221 drives the display panel 210.

Specifically, the timing controller 221 converts a video signal into data appropriate for features of the display panel 210, rearranges the converted data, based on a structure of the pixels of the display panel 210, and delivers the rearranged data to a source driver IC. Additionally, the timing controller 221 generates an IC timing control signal of a gate/source driver for driving of the display panel 210, and drives the display panel 220.

Further, the timing controller 221 performs a first operation for preventing afterimages appearing on the display panel 210. In this case, the first operation may be an operation of correcting a threshold voltage shift of each of the plurality of driving thin film transistors in the display panel 210.

Specifically, the first operation may be an off RS (off sequence real time slow mode) operation. The off RS operation may be an operation of compensating degradation of the plurality of thin film transistors included in the display panel 210 and eliminating afterimages. The off RS operation is performed when the display apparatus 100 is powered off if the user's accumulated watch time is specific hours (e.g., four hours) or greater. The off RS operation involves controlling current flowing in the thin film transistors and correcting threshold voltage when threshold voltage of the plurality of thin film transistors is shifted. Accordingly, degradation of the OLED element is prevented.

Additionally, the timing controller 221 generates a history map of the first operation. In this case, the history map includes information on the number of corrections of a threshold voltage shift of each of the plurality of driving thin film transistors.

That is, the first operation is an operation of correcting a threshold voltage shift of each of the plurality of driving thin film transistors, and is repeated. Thus, information on the number of corrections of a threshold voltage shift of each of the plurality of driving thin film transistors is stored in the history map.

Additionally, the history map is updated as a result of repetition of the first operation. The history map may be stored in the first memory 222, for example, a first DDR (double data rate).

FIG. 4 is a view for describing the concept of a history map of one embodiment.

Referring to FIG. 4, the history map has the same size as the display panel 210 or an image displayed on the display panel 210. Further, information on the number of corrections of a threshold voltage shift of each of the plurality of driving thin film transistors is additionally stored on the history map.

In an example, suppose that a single pixel of the display panel 210 includes four cells corresponding to WRGB. Information "2" of the history map's first cell denotes the number of corrections of a threshold voltage of a driving thin film transistor corresponding to a W cell of the display panel 210's pixel (1, 1). Information "5" of the history map's second cell denotes the number of corrections of a threshold voltage of a driving thin film transistor corresponding to an R cell of the display panel 210's pixel (1, 1). Information "75" of the history map's third cell denotes the number of corrections of a threshold voltage of a driving thin film transistor corresponding to a G cell of the display panel 210's pixel (1, 1). Information "20" of the history map's fourth cell denotes the number of corrections of a threshold voltage of a driving thin film transistor corresponding to a B cell of the display panel 210's pixel (1, 1). Additionally, information "9" of the history map's fifth cell denotes the number of corrections of a threshold voltage of a driving thin film transistor corresponding to a W cell of the display panel 210's pixel (1, 2).

Components of the display apparatus 200 are described with reference to FIG. 2 as follows.

The main controller 231 may be included in a main board inside the display apparatus 200, embodied as a system on a chip (SoC), and supply an image to the display panel 210. Additionally, the main controller 231 may control another component of the display apparatus 200.

Specifically, the main controller 231 stores an image received through HDMI or RF in a second memory 232 inside the main board, for example, a second DDR, and an image quality engine part embodied as a module in the main controller 231 processes the stored image. The processed image is displayed on the display panel 210.

In particular, the main controller 231 performs a second operation for preventing afterimages, based on the history map stored in the first memory and a original luminance value (a brightness value) of the image stored in the second memory.

In this case, the second operation may be an operating of reducing a luminance value of at least one area of an image to be displayed on the display panel 210 to a value lower than a original luminance value of the at least one area. The control over a luminance value may be performed by controlling current supplied to the plurality of driving thin film transistors.

That is, the second operation involves controlling current supplied to at least a portion of the plurality of driving thin film transistors, and reducing a luminance value of at least one area in an image to a value lower than a original luminance value of the at least one area.

Each of at least one area in the image may be an area that consists of one or more pixels where a original luminance value in the image is higher than a reference luminance value, among the plurality of pixels included in the image. Alternatively, at least one area in the image may be respectively an area that consists of one or more pixels where a original luminance value in the image does not change for a specific period, among the plurality of pixels included in the image.

Hereafter, features of the main controller 231's performance of the second operation to prevent residua images is specifically described.

FIG. 5 is a flow chart showing a method for controlling a display apparatus of a first embodiment. Hereafter, each of the steps performed is described.

In step 510 (S510), the main controller 231 reads a history map stored in the first memory.

The history map, as described above, may be generated in advance by the timing controller 221, and based on a first operation (i.e., an off RS operation) performed multiple times by the timing controller 221, may be generated. That is, as described above, the history map contains information on the number of corrections of a threshold voltage shift of each of the plurality of driving thin film transistors included in the display panel 210.

In step 520 (S520), the main controller 231 reads an image in the second memory. The image may be an image to be displayed on the display panel 210, and may be received through HDMI or RF and stored in the second memory.

In step 530 (S530), the main controller 231 searches for at least one area, based on original luminance values of all the pixels in the image.

In one embodiment, at least one area in the image may be respectively an area that consists of one or more pixels where a original luminance value in the image is higher than a reference luminance value, among the plurality of pixels included in the image. The reference luminance value is a relatively high luminance value, and may be set statistically or experimentally. That is, the area may be a portion of the area where a luminance value is high in the image, i.e., a portion of the image where a brightness value is high in the image.

In another embodiment, at least one area in the image may be respectively an area that consists of one or more pixels where a original luminance value in the image does not change for a previous specific period, among the plurality of pixels included in the image. That is, the area may be a portion of the image where a specific logo and the like is displayed in a specific position for the previous specific period (e.g., two minutes). In other words, the area may be a portion of the image where a scene does not change in the image for the previous specific period.

In step 540 (S540), the main controller 231 performs a second operation of reducing current supplied to two or more driving thin film transistors included in at least one area in the display panel 210, based on a original luminance value of at least one area in the image and the number of corrections of threshold voltage shifts of the two or more driving thin film transistors. In this case, the at least one area in the image is the same as the at least one area in the display panel 210.

That is, step 540 (S540) may involve controlling current, using a driving thin film transistor as a basic unit.

In this case, the main controller 231 may decrease current supplied to the two or more driving thin film transistors included in the at least one area in the display panel 210 to be inversely proportional to the original luminance value of the at least one area in the image and the number of corrections of the threshold voltage shifts of the two or more driving thin film transistors.

Specifically, as described above, each of at least one area is an area where a original luminance value is high or a scene does not change, and two or more driving thin film transistors for emitting light in at least one area are highly degraded (or deteriorated) due to the above state of the luminance value. To prevent degradation, the main controller 231 may decrease current supplied to two or more driving thin film transistors to be be inversely proportional to luminance values of two or more pixels included in at least one area. For convenience of description, the above-described operation is referred to as a "2-1st operation" that constitutes the second operation.

Additionally, a driving thin film transistor where a threshold voltage shift is corrected a large number of times may be included in at least one area, and the driving thin film transistor where a threshold voltage shift is corrected a large number of times is significantly degraded. To solve the problem, a luminance value needs to decrease. That is, the main controller 231 may decrease current of two or more driving thin film transistors included in the at least one area to be inversely proportional to the number of corrections of threshold voltage shifts of the two or more driving thin film transistors. For convenience of description, the above-described operation is referred to as a "2-2nd operation" that constitutes the second operation.

FIG. 6 is a view for describing the concept of the second operation of a main controller 231 of one embodiment.

Referring to FIG. 6, the main controller 231 may decrease a luminance value of at least one area by reducing current supplied to two or more driving thin film transistors (the right drawing), based on both of the original luminance value of the at least one area (the upper-left drawing) and the number of corrections of threshold voltage shifts of the two or more driving thin film transistors (i.e., a history map; the lower-left drawing).

In an example, since the at least one area is an area where a original luminance value is high, a driving thin film transistor, where threshold voltage shifts are corrected a large number of times, decreases the luminance value to a value 30%~40% lower than the original luminance value, among two or more driving thin film transistors included in the at least one area (the 2-2nd operation), while the luminance value decreases 20% lower than the original luminance value (the 2-1st operation).

In one embodiment, among the two or more driving thin film transistors, a driving thin film transistor having the number of corrections of threshold voltage shifts less than a reference value does not perform the 2-2nd operation, and a driving thin film transistor having the number of corrections of threshold voltage shifts, which are the reference value or greater, may perform the 2-2nd operation in adverse proportion to the number of corrections of the threshold voltage shifts. This is because afterimages do not appear even if a driving thin film transistor where threshold voltage shifts are corrected a very small number of times does not perform the 2-2nd operation.

In step 550 (S550), the main controller 231 transmits the image to which the second operation is performed to the timing controller 221.

In step 560 (S560), the timing controller 221 displays the image to which the second operation is performed on the display panel 210.

Each of the steps in FIG. 5 may be performed regardless of its order, or performed at the same time. The operations in each step may be implemented in hardware and/or software.

In summary, the size of OLED TVs has become larger recently. For an 8K OLED TV, 33177600 OLED elements are used, and the number is four times more than the number of OLED elements of a 4K OLED TV. As the number of OLED elements increase, a threshold voltage shift of a driving thin film transistor is highly likely to occur. According to the present disclosure, a physically vulnerable cell is searched for based on the first operation, and when a portion of an image, where a original luminance value is high, overlaps the vulnerable cell, current flowing in the cell is controlled based on the second operation to prevent degradation of a driving thin film transistor in the cell.

FIG. 7 is a flow chart showing a method for controlling a display apparatus of a second embodiment. Hereafter, each of the steps performed is described.

In step 710 (S710), the main controller 231 reads a history map stored in the first memory.

In step 720 (S720), the main controller 231 reads an image in the second memory.

In step 730 (S730), the main controller 231 searches for at least one area, based on original luminance values of all the pixels in the image.

In one embodiment, at least one area in the image may be respectively an area that consists of one or more pixels where a original luminance value in the image is higher than a reference luminance value, among the plurality of pixels included in the image. In another embodiment, at least one area in the image may be respectively an area that consists of one or more pixels where a original luminance value in the image does not change for a previous specific period, among the plurality of pixels included in the image.

In step 740 (S740), the main controller 231 performs a second operation of reducing a luminance value of a pixel, based on a original luminance value of a pixel included in at least one area in the image and the number of corrections of a pixel included in at least one area in the display panel 210. In this case, the position of the pixel included in the at least one area in the image is the same as the position of the pixel included in the at least one area in the display panel 210. Additionally, the operation of "reducing a luminance value of a pixel" corresponds to the operation of "identically reducing current supplied to driving thin film transistors included in a pixel".

That is, step 740 (S740) may involve controlling current, using a pixel as a basic unit. By controlling the current in a pixel unit, the amount of calculation of the main controller 231 may be reduced.

In this case, the main controller 231 may decrease the luminance value of the pixel to be inversely proportional to the original luminance value of the pixel and the number of corrections of the pixel.

Similarly, the main controller 231 may decrease a luminance value of a pixel, based on a original luminance value of the pixel, and then further decrease the luminance value of the pixel, based on the number of corrections of the pixel.

The number of corrections of a pixel may relate to the number of corrections of threshold voltage shifts of driving thin film transistors included in the pixel.

In one embodiment, the number of corrections of a pixel may correspond to an average of the number of corrections of threshold voltage shifts of driving thin film transistors included in the pixel.

In an example, when the number of corrections of threshold voltage shifts of four driving thin film transistors included in a single pixel are "2, 5, 75, 20", the number of corrections of the pixel may be "25.5".

In another embodiment, the number of corrections of a pixel may correspond to a maximum of the number of corrections of threshold voltage shifts of driving thin film transistors included in the pixel.

That is, in a pixel, three or four cells are combined to emit a light, and in the case of an operational error of any one of three or four driving thin film transistors, the pixel emits a light with afterimages. To effectively prevent afterimages, the main controller 231 may set a maximum of the number of corrections of threshold voltage shifts of driving thin film transistors included in a pixel to the number of corrections of the pixel.

In an example, when the number of corrections of threshold voltage shifts of four driving thin film transistors included in a single pixel is "2, 5, 75, 20", the number of corrections of the pixel may be "75".

In step 750 (S750), the main controller 231 transmits the image to which the second operation is performed to the timing controller 221.

In step 760 (S760), the timing controller 221 displays the image to which the second operation is performed on the display panel 210.

Each of the steps in FIG. 7 may be performed regardless of its order, or performed at the same time. The operations in each step may be implemented in hardware and/or software.

FIG. 8 is a flow chart showing a method for controlling a display apparatus of a third embodiment. Hereafter, each of the steps performed is described.

In step 810 (S810), the main controller 231 reads a history map stored in the first memory.

In step 820 (S820), the main controller 231 reads an image in the second memory.

In step 830 (S830), the main controller 231 searches for at least one area, based on original luminance values of all the blocks in the image.

The block includes two or more pixels that are arranged two-dimensionally. In an example, the block includes 3×3 pixels or 4×4 pixels. Additionally, a luminance value of the block may be an average of luminance values of two or more pixels in the block.

In one embodiment, at least one area in the image may be respectively an area that consists of one or more blocks where a original luminance value in the image is higher than a reference luminance value, among a plurality of blocks included in the image. In another embodiment, at least one area in the image may be respectively an area that consists of one or more blocks where a original luminance value in the image does not change for a previous specific period, among the plurality of blocks included in the image.

In step 840 (S840), the main controller 231 performs a second operation of reducing a luminance value of a block, based on a original luminance value of a block included in at least one area in the image and the number of corrections of a block included in at least one area in the display panel 210. In this case, the operation of "reducing a luminance value of a block" corresponds to the operation of "identically reducing current supplied to driving thin film transistors included in two or more pixels included in a block.

That is, step 840 (S840) may involve controlling current, using a block as a basic unit. By controlling the current in a pixel unit, the amount of calculation of the main controller 231 may be reduced.

In this case, the main controller 231 may decrease a luminance value of a block to be inversely proportional to a original luminance value of the block and the number of corrections of the block.

Similarly, the main controller 231 may decrease a luminance value of a block, based on the original luminance value of the block, and then further decrease the luminance value of the block, based on the number of corrections of the block.

The number of corrections of a block may relate to the number of corrections of threshold voltage shifts of driving thin film transistors included in the block.

In one embodiment, the number of corrections of a block may correspond to an average of the number of corrections of threshold voltage shifts of driving thin film transistors included in the block. In another embodiment, the number of corrections of a block may correspond to a maximum of the number of corrections of threshold voltage shifts of driving thin film transistors included in the block.

In step 850 (S850), the main controller 231 transmits the image to which the second operation is performed to the timing controller 221.

In step 860 (S860), the timing controller 221 displays the image to which the second operation is performed on the display panel 210.

Each of the steps in FIG. 8 may be performed regardless of its order, or performed at the same time. The operations in each step may be implemented in hardware and/or software In the case of a block where a luminance value decreases a lot in step 840 (S840), there may be a big difference between the luminance value of the block and a luminance value of another adjacent block, thereby causing a flicker.

In one embodiment, the main controller 230 may control the luminance value of a pixel of a block located at the boundary of at least one region among the blocks in which the luminance value is decreased by the second operation to increase toward the boundary.

That is, referring to FIG. 9, a block includes 9 (3×3) pixels, a luminance value of a block (a gray block) on the boundary is reduced to 60, and a luminance value of a block (a white block) adjacent to the block (gray block) is 80. In this case, the main controller 230 may control the luminance value of the block so that a luminance value of a pixel included in the block can increase toward the boundary.

In summary, the display apparatus 200 and the method for controlling the same according to the present disclosure help not only to correct physically vulnerable driving thin film transistors in the display panel 210 but also to generate a history map, and based on the generated history map, performs the second operation based on an image quality algorithm that compensates afterimages, using an off RD operation and the like. Thus, afterimages generated in the display apparatus 200 may decrease, degradation of OLED elements in the display apparatus 200 may be prevented, and the lifespan of the display panel 210 may increase.

Even though all the components of the embodiments in the present disclosure are described as being combined into one component or operating in combination, embodiments are not limited to the embodiments set forth herein, and all the components can be selectively combined to operate within the scope of the purpose of the disclosure. All the components can be respectively embodied as an independent hardware, or some or all of the components can be selectively combined and can be embodied as a computer program including a program module that performs some or all functions combined into one or more hardwares. Codes or code segments of the computer program can be easily inferred by one having ordinary skill in the art. The computer program can be stored in a computer-readable recording medium and can be read and executed by a computer, whereby the embodiments in the disclosure can be realized. Examples of a storage medium of the computer program include storage mediums including a magnetic recording medium, an optical recording medium and a semiconductor recording element. The computer program for realizing the embodiments in the disclosure includes a program module which is transmitted via an external device in real time.

The embodiments are described above with reference to a number of illustrative embodiments thereof. However, embodiments are not limited to the embodiments and drawings set forth herein, and numerous other modifications and embodiments can be devised by one skilled in the art. Further, the effects and predictable effects based on the configurations in the disclosure are to be included within the range of the disclosure though not explicitly described in the description of the embodiments.

The invention claimed is:

1. A display apparatus, comprising:

a display panel;

a timing controller driving the display panel, performing a first operation for preventing afterimages appearing on the display panel, and generating a history map of the first operation; and a main controller providing an image to the display panel, and performing a second operation for preventing the afterimages, based on the history map and an original luminance of an image to be displayed on the display panel, wherein the image to which the second operation is performed is displayed on the display panel, wherein the main controller searches for at least one area in the image, based on an original luminance value of a plurality of pixels included in the image, and wherein the main controller decreases current supplied to a plurality of driving transistors included in at least one area in the display panel, which corresponds to at least one area in the image, to be inversely proportional to an original luminance value of the at least one area in the image and a number of corrections of threshold voltage shifts of the two or more driving transistors.

2. The display apparatus of claim 1, wherein the first operation is an operation of correcting a threshold voltage shift of each of the plurality of driving transistors, and wherein the history map comprises information on the number of corrections of a threshold voltage shift of each of the plurality of driving transistors.

3. The display apparatus of claim 2, wherein the second operation is an operation of decreasing a luminance value of the at least one area in the image to a value lower than the original luminance value of the at least one area by controlling current of at least a portion of the plurality of driving transistors.

4. The display apparatus of claim 3, wherein the at least one area in the image is respectively an area that comprises one or more pixels in which the original luminance value is higher than a reference luminance value, among the plurality of pixels included in the image.

5. The display apparatus of claim 3, wherein at least one area in the image is respectively an area that comprises one or more pixels in which the original luminance value does not change for a previous specific period, among the plurality of pixels included in the image.

6. The display apparatus of claim 3, wherein the main controller searches for at least one area in the image, based on the original luminance value of the plurality of pixels included in the image, wherein the main controller decreases a luminance value of at least one pixel of the plurality of pixels included respectively in at least one area in the image to be inversely proportional to an original luminance value of the pixel included in the at least one area in the image and the number of corrections of a pixel included in the display panel, which corresponds to the pixel included in the at least one area in the image, and wherein the number of corrections of a pixel involves the number of corrections of a threshold voltage shift of driving transistors included in the pixel.

7. The display apparatus of claim 6, wherein the number of corrections of a pixel corresponds to an average of the number of corrections of a threshold voltage shift of driving transistors included in the pixel.

8. The display apparatus of claim 6, wherein the number of corrections of a pixel corresponds to a maximum of the number of corrections of a threshold voltage shift of driving transistors included in the pixel.

9. The display apparatus of claim 3, wherein the image and the display panel respectively comprise a plurality of blocks, and each of the plurality of blocks comprises two or more pixels, wherein the main controller searches for at least one area in the image, based on a on an original luminance value of a plurality of blocks included in the image, wherein the main controller decreases a luminance value of at least one block included respectively in the at least one area in the image to be inversely proportional to an original luminance value of the block included in the image and the number of corrections of a block included in the display panel, which corresponds to the block included in the image, and wherein the luminance value of the block is an average of luminance values of two or more pixels in the block, and the number of corrections of the block is calculated based on the number of corrections of threshold voltage shifts of driving transistors included in the block.

10. The display apparatus of claim 9, wherein the number of corrections of the block corresponds to an average of the number of corrections of threshold voltage shifts of the driving transistors included in the block.

11. The display apparatus of claim 9 wherein the number of corrections of the block corresponds to a maximum of the number of corrections of threshold voltage shifts of the driving transistors included in the block.

12. The display apparatus of claim 9, wherein the main controller controls a luminance value of a block located at the boundary of the at least one area among blocks where a luminance value is decreased by the second operation to increase toward the boundary.

13. A display apparatus, comprising:

a display panel;

a timing controller performing a first operation of correcting a threshold voltage shift of a plurality of driving transistors included in the display panel, and generating a history map of the first operation;

a memory storing the history map; and a main controller performing a second operation of adjusting the stored history map and a luminance value of an image to be displayed on the display panel, and transmitting the image to which the second operation is performed to the display panel, wherein the main controller searches for at least one area in the image, based on an original luminance value of a plurality of pixels included in the image, and wherein the main controller decreases current supplied to two or more driving transistors included in at least one area in the display panel, which corresponds to the at least one area in the image, to be inversely proportional to an original luminance value of the at least one area in the image and the number of corrections of threshold voltage shifts of the two or more driving transistors.

14. A method for controlling a display apparatus, comprising:

generating, by a timing controller, a history map by performing a first operation multiple times for preventing afterimages appearing on a display panel;

performing, by a main controller, a second operation for preventing the afterimages based on the history map and an original luminance value of an image to be displayed on the display panel; and displaying the image to which the second operation is performed on the display panel, wherein performing the second operation comprises:

searching for at least one area in the image, based on an original luminance value of a plurality of pixels included in the image; and decreasing current supplied to two or more driving transistors included in at least one area in the display panel, which corresponds to the at least one area in the image, to be inversely proportional to an original luminance value of the at least one area in the image and a number of corrections of threshold voltage shifts of the two or more driving transistors.

15. The method of claim 14, wherein the display panel comprises a plurality of driving transistors, wherein the first operation is an operation of correcting a threshold voltage shift of each of the two or more driving transistors, and wherein the history map comprises information on the number of corrections of the threshold voltage hifts of each of the two or more driving transistors.

16. The method of claim 15, wherein the second operation is an operation of decreasing a luminance value of at least one area in the image to a value lower than the original luminance value of the at least one area by controlling current of at least a portion of the two or more driving transistors.

17. The method of claim 16, wherein at least one area in the image is respectively an area that comprises one or more pixels in which the original luminance value is higher than a reference luminance value, among a plurality of pixels included in the image.

18. The method of claim 16, wherein at least one area in the image is respectively an area that comprises one or more pixels in which the original luminance value does not change for a previous specific period, among a plurality of pixels included in the image.

* * * * *